US005352064A

United States Patent [19]

Carruthers et al.

[11] Patent Number: 5,352,064

[45] Date of Patent: Oct. 4, 1994

[54] COLLAPSIBLE SPACER

[75] Inventors: Bruce M. Carruthers, Calgary; F. Gordon French, Winnipeg; B. Wayne Heath, Warman; Randal B. Smith, Calgary, all of Canada

[73] Assignee: Plasti-Fab Ltd., Calgary, Canada

[21] Appl. No.: 96,737

[22] Filed: Jul. 22, 1993

Related U.S. Application Data

[63] Continuation of Ser. No. 859,148, Mar. 27, 1992, abandoned.

[30] Foreign Application Priority Data

Apr. 26, 1991 [CA] Canada ..... 2041324

[51] Int. Cl.[5] ..... E02D 5/00

[52] U.S. Cl. ..... 405/229; 52/169.5; 52/169.11; 404/64; 404/74; 405/258

[58] Field of Search ..... 405/229, 230, 38, 36; 52/169.11, 169.9, 169.5, 294, 480; 404/64, 65, 74

[56] References Cited

U.S. PATENT DOCUMENTS

| | | | |
|---|---|---|---|
| 2,743,602 | 5/1956 | Dunn | 52/169.11 X |
| 4,658,267 | 8/1987 | Workman | 52/577 |
| 4,702,048 | 10/1987 | Millman | 52/169.11 X |
| 4,745,716 | 5/1988 | Kuypers | 52/169.5 |
| 4,799,348 | 1/1989 | Brami et al. | 52/169.9 X |
| 4,869,032 | 9/1989 | Geske | 52/169.5 |
| 5,067,298 | 11/1991 | Petersen | 52/169.5 X |
| 5,085,539 | 2/1992 | Massarsch | 405/229 |

FOREIGN PATENT DOCUMENTS

| | | | |
|---|---|---|---|
| 3444728 | 6/1986 | Fed. Rep. of Germany | 52/169.11 |
| 3546032 | 6/1987 | Fed. Rep. of Germany | 52/169.11 |

*Primary Examiner*—Dennis L. Taylor
*Attorney, Agent, or Firm*—Baker & Daniels

[57] ABSTRACT

A collapsible spacer for disposition between a form for a concrete foundation member and the underlying soil includes voids to allow the spacer to deform permanently and occupy a reduced volume when upheaving of the soil occurs. The spacer is fabricated from a material, such as expanded polystyrene foam, whose structural strength is not significantly altered by exposure to moisture. Embodiments of the spacer which are suited for use with forms for foundation beams and slabs are discussed.

8 Claims, 6 Drawing Sheets

COLLAPSIBLE SPACER

This is a continuation of application Ser. No. 07/859,148, filed Mar. 27, 1992, now abandoned.

BACKGROUND OF THE INVENTION

The present invention relates to spacers. More specifically, the present invention relates to spacers acting between a soil grade and the bottom of a form for a concrete foundation member, such as a slab or beam, the spacers being collapsible when the soil under them swells due to water resorption and the like.

Construction of the foundation of a building generally includes the steps of: excavating a foundation pit; placing pilings; digging trenches between the pilings and pouring concrete beams in the trenches; and pouring a reinforced concrete foundation slab over the beams and onto the soil grade between the beams.

Problems exist with the above mentioned construction method in that in certain soil conditions, for example in dense clay soils, the soil in the excavated pit will dry out, thus shrinking, during the time span between excavation and the pouring of the foundation members. Eventually, once the foundation members are poured and set, the soil will resorb water and re-expand. This re-expansion of the soil generates significant forces on the foundation members which it contacts. In many circumstances these forces are sufficient to heave, crack or shatter the slab and/or beams of the foundation.

Previous attempts have been made to solve this problem by providing a spacer between the concrete foundation members and the soil. One prior art technique to provide this spacer employs a layer of corrugated cardboard boxes which are placed on the soil. The upper surface of the boxes function as the lower surface of the form for the foundation member and the concrete is poured onto them. When the soil is subsequently infused with water, the soil expands into the void between the member and the soil created by the boxes, crushing the boxes, but avoiding cracking or breakage of the slab or beam. A box for use in this technique is shown in U.S. Pat. No. 4,685,267 to Workman.

However, problems exist with this technique in that it is labour intensive to fold and place the boxes on the soil. It is also difficult to prevent the boxes from becoming damp and collapsing prior to pouring or setting of the concrete members.

Attempts have been made to overcome these difficulties by employing resilient polystyrene foam slabs instead of corrugated cardboard boxes. However problems exist with this technique as well in that the polystyrene foam slabs are relatively expensive and they are resilient when compressed. Specifically, the polystyrene foam slab will be compressed between the soil and the underside of the foundation member as the soil expands. Due to its resilient nature, as the slab is compressed it generates a reaction force between the bodies compressing it and once the soil has expanded to the point where the reaction force produced by the slab is sufficient, the foundation member will break or heave.

The reaction force produced depends upon the density, uncompressed thickness and amount of compression of the slab, with the force increasing with the amount of compression. It is therefore necessary to increase the uncompressed thickness of the slab to reduce the reaction force produced by a given amount of soil expansion.

For example, a six inch thick slab of polystyrene foam may, depending upon the density of the foam used, be compressible to four inches before a reaction force is produced which would damage a foundation member, thus safely allowing up to two inches of soil expansion to occur. To accommodate three inches of soil expansion, a ten inch thick slab of polystyrene foam may be required, the slab being compressible to seven inches before a reaction force is produced which would damage the foundation member.

As is apparent, any increase in the required safe range of soil expansion will lead to an increase in the volume, and therefore the expense, of the required polystyrene foam slabs. Furthermore, greater excavation of the construction site may be required to accommodate the thicker polystyrene foam members.

It is an object of the present invention to provide a novel spacer which obviates or mitigates at least one of the above-mentioned disadvantages.

According to the present invention there is provided a collapsible spacer of water resistant material for disposition between a soil grade and a form, the spacer comprising voids to allow permanent deformation of the spacer when a predetermined load upon the spacer is exceeded.

Embodiments of the present invention will now be described, by way of example only, with reference to the attached figures wherein.

Figure 1:
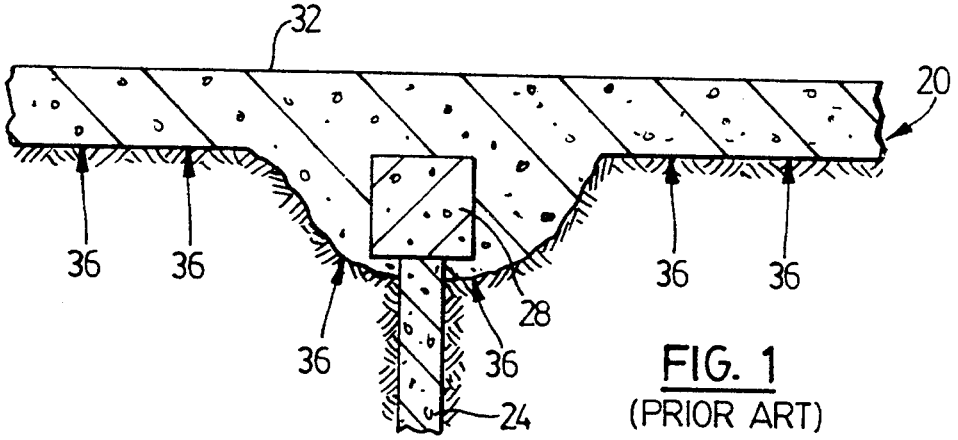
FIG. 1 (PRIOR ART)
FIG. 1 shows a section of a prior art foundation slab, beam and piling.

To clarify the present invention, brief reference will be made to the prior an technique of constructing a concrete foundation slab with reference to FIG. 1.

The soil grade at the bottom of an excavated pit for a foundation is shown generally at 20. A series of footings or pilings 24 have been placed in the soil and beams 28 have been cast between the pilings 24. The beam may protrude above the grade 20 if desired or may be substantially flush with the surrounding grade as shown in the Figure. A concrete foundation slab 32 is then poured over the grade 20 and the beams 28.

As discussed previously, when the construction site is excavated, the soil may dry out leading to shrinkage of the soil upon which the foundation will subsequently be formed. When the soil resorbs water after the foundation members have been poured and set, the soil will expand, creating a significant force on the foundation beam 28 and slab 32 as indicated by arrows 36. When sufficient force is exerted on the foundation members 28 and 32, they will crack and/or heave.

Figure 3:
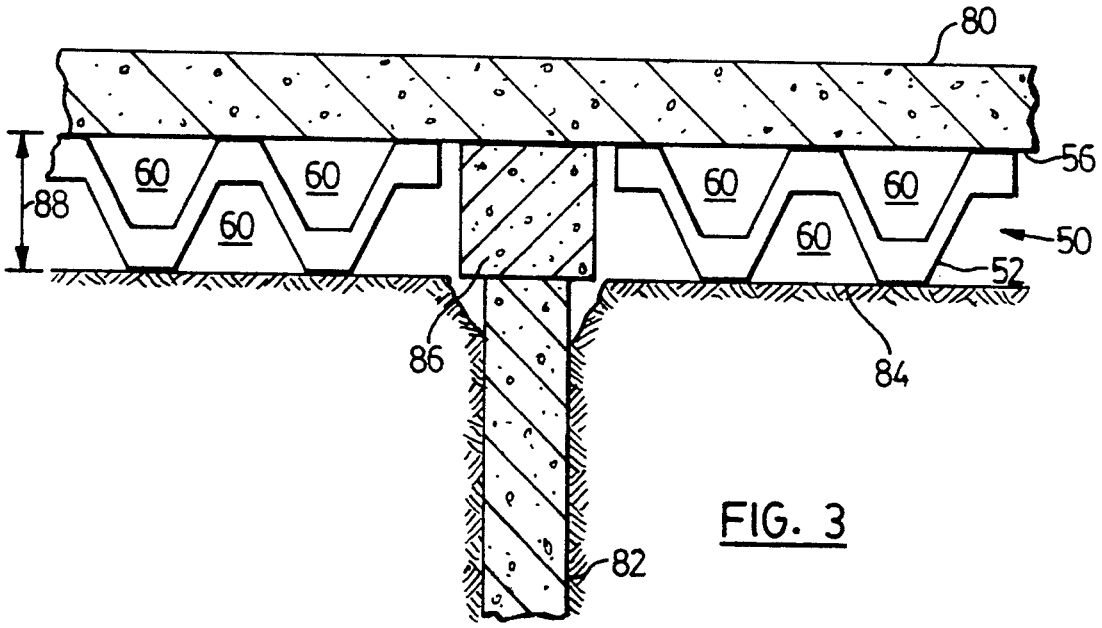
FIG. 3 shows a foundation slab formed with the spacer assembly of FIG. 2.
Figure 4:
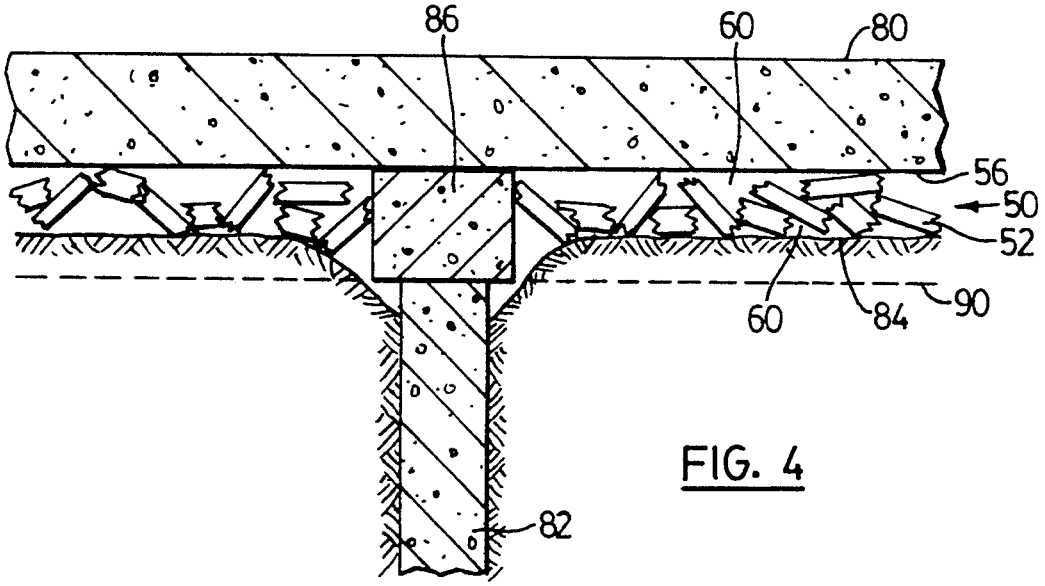
FIG. 4 shows the foundation slab of FIG. 3 wherein the spacer has been deformed permanently.
Figure 2:
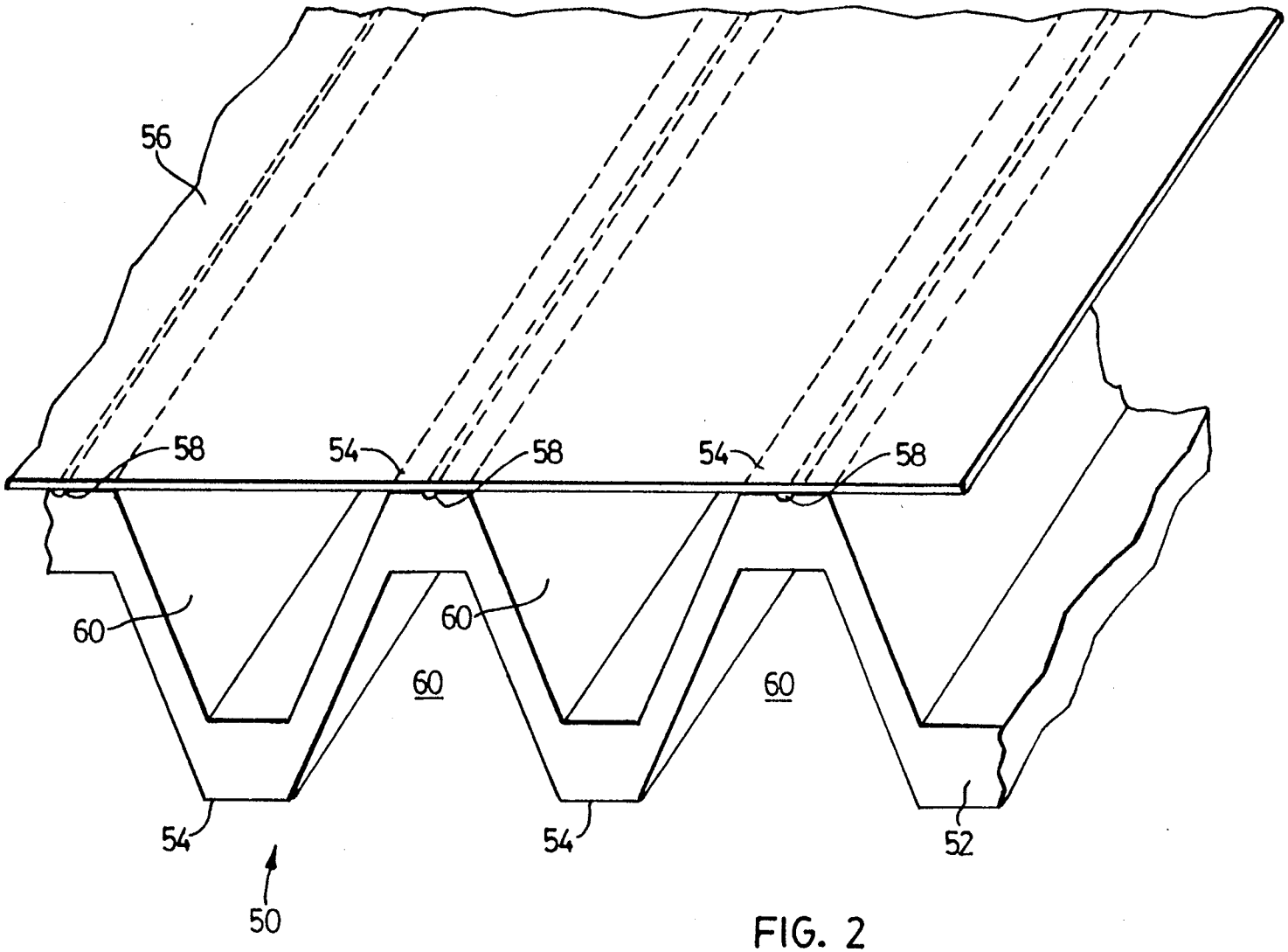
FIG. 2 shows an oblique view of a portion of a spacer assembly.

Referring now to FIGS. 2 through 4, an assembly employing a spacer according to the present invention is shown generally at 50. The assembly 50, which is suitable for disposition between a soil grade and the bottom of a form, includes a spacer 52 which is formed from a suitable rigid water resistant material, such as polystyrene foam made by extrusion or by bead foam techniques or any other material whose load bearing capabilities are unchanged by exposure to moisture.

The spacer 52 has a cross section which is similar to a plurality of adjacent generally W-shaped sections and the upper and lower vertices of the W-shaped sections include fiat portions 54 which define spaced support planes, suitable for abutting a form and the underlying soil respectively. The W-shaped sections of the spacer 52 create elongated laterally spaced voids 60 throughout the body of the spacer.

A planar base 56 of a material suitable for use in a concrete form, such as chipboard, is fixed to the upper support plane at the flat portions 54 of the upper vertices of each W-shaped section by a bead 58 of suitable adhesive material.

In use, the spacer 52 is preferably pre-assembled with the base 56 to form the assembly 50, although it is also contemplated that the assembly 50 could be fabricated at the construction site as required, reducing the shipping and storage requirements. If preassembled, the assembly 50 would conveniently be available in sizes common to the construction industry, such as four by eight foot units, and would be cut to size using standard tools and used as the base of a form for pouring concrete.

In both alternatives, the dimensions of the spacers 52 are pre-selected to enable the spacer 52 to support the dead load of the concrete poured into the form above the excavated soil grade. It is contemplated that spacers 52 with different load supporting capacities are to be provided for favorable use in forms for different weights of concrete. For example a spacer 52 for supporting an eight inch thick concrete foundation slab would require a higher load handling ability than one supporting a four inch thick slab.

Table I includes a list of dead loads, in pounds per square inch, for various slab thickness of normal density concrete (150 lbs/ft$^3$).

TABLE I

| SLAB THICKNESS INCH (mm) | DEAD LOAD PSI (KPa) |
|---|---|
| 4 (100) | 0.35 (2.35) |
| 6 (150) | 0.52 (3.53) |
| 8 (200) | 0.69 (4.71) |
| 10 (250) | 0.87 (5.89) |
| 12 (300) | 1.04 (7.06) |

FIG. 3 shows a concrete foundation slab 80 which has been formed using the assemblies 50. As previously discussed, pilings 82 have been placed in an excavated soil grade 84 and beams 86 have been formed between them. A form has been constructed using assemblies 50 wherein the base 56 of the assemblies 50 comprise the bottom of the form and the flat portions 54 of the lower vertices of the W-shaped sections of the assemblies 50 abut the soil grade 84. In the Figure, the side elements of the form are not shown and may be removed once the slab has set.

The space 88 between the soil grade 84 and the member 80 is selected to accommodate the expected soil expansion after the foundation member has cured. The voids 60 in spacer 52 occupy a substantial proportion of the volume defined by the space 88 and this proportion is limited by the requirements that the spacer 52 can safely support the dead load generated by the weight of the form and the concrete poured into it, and the live load generated by the weight of the workmen and their tools while the foundation member is being constructed. As will be apparent, the voids 60 allow the spacer 52 to permanently deform to a reduced volume as the space 88 is decreased by expansion of the soil grade 84.

FIG. 4 shows the foundation members of FIG. 3 after the expansion of the soil grade from its construction position, indicated by dotted line 90, to its expanded position. As can be seen in the Figure, the spacer 52 has been crushed or otherwise permanently deformed as space 88 is reduced by the expansion of the soil. The spacer 52 occupies a reduced overall volume wherein the proportion of the volume occupied by the voids 60 has been reduced. The deformation of the spacer 52 allows the expansion of the soil grade 84 to occur without damaging the foundation slab 80.

As is apparent, there are therefore two limitations on the selection of the design of the spacer 52: the spacer must be able to support the sum of the above-mentioned dead and live loads when the foundation members are being constructed; and the spacer must deform at a load less than the minimum load which would otherwise damage the foundation member.

From tests, the spacer 52 shown in FIG. 2, when constructed from $\frac{5}{8}''$ polystyrene foam fabricated by bead techniques and providing a five inch space between the upper and lower flat portions 54, has been found to crush at a load of 3.05 pounds per square inch, which occurs at a deflection of approximately 0.3 inches. In the configuration shown, the five inch height of the spacer provides a maximum soil expansion of three inches.

Figure 6:
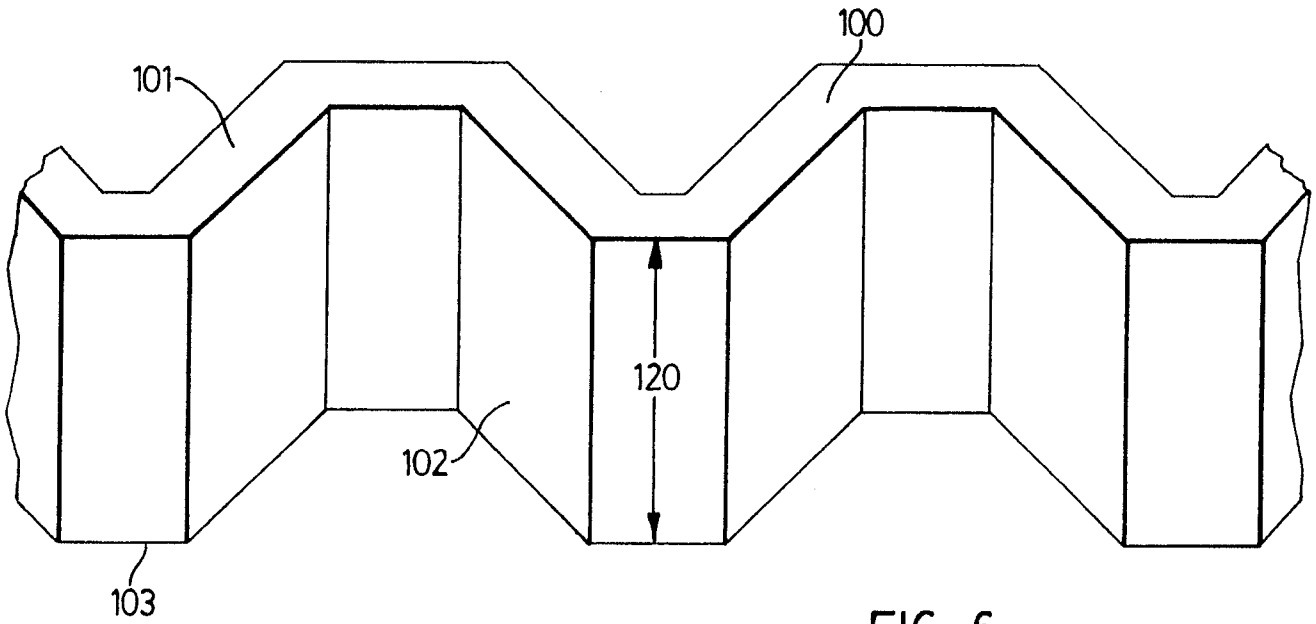
FIG. 6 shows an oblique view of the spacer of FIG. 5.
Figure 5:
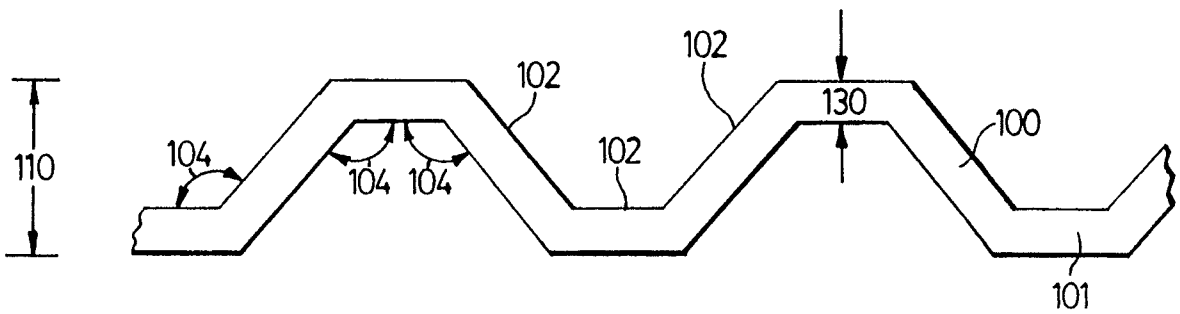
FIG. 5 shows a top view of another spacer.
Figure 7:
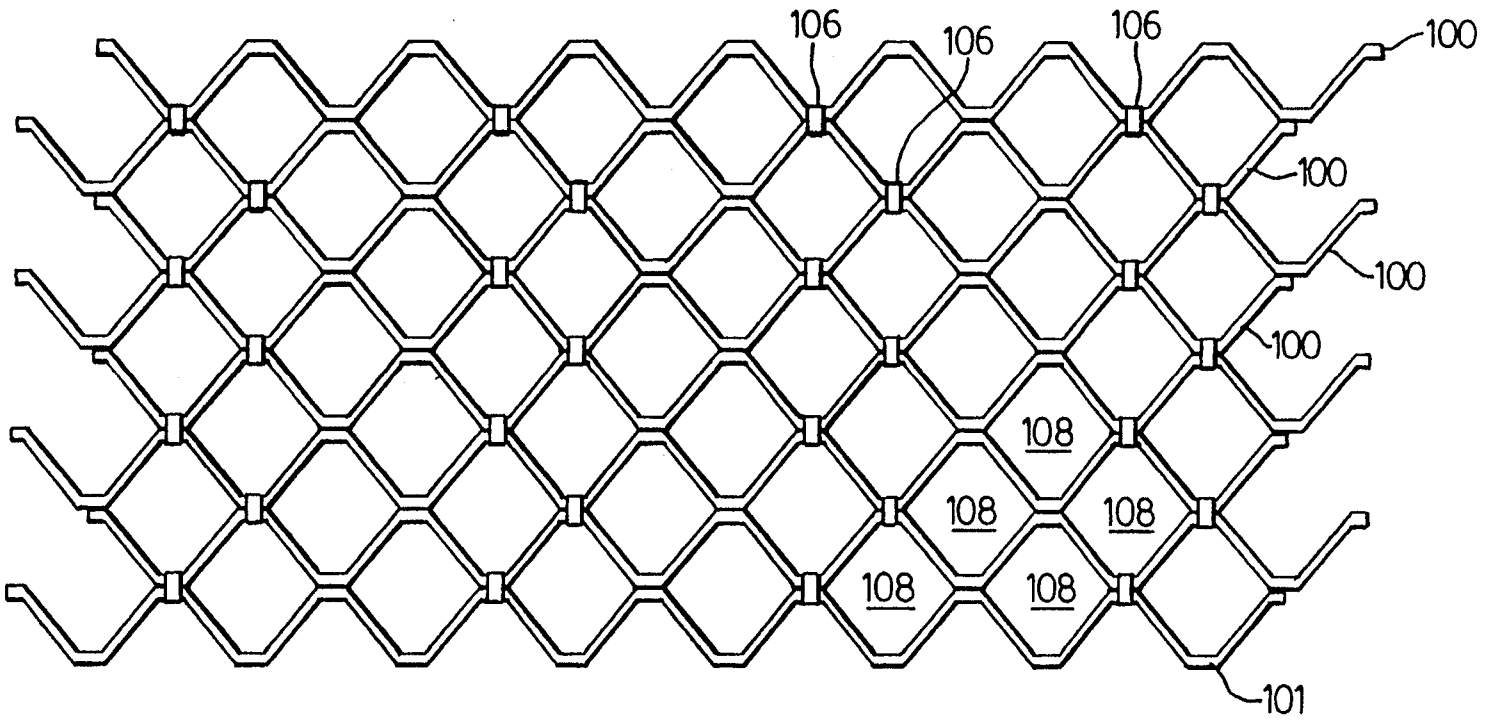
FIG. 7 shows a top view of an assembly of the spacers of FIG. 5.

Referring now to FIGS. 5 through 7, another embodiment of the present invention is shown and is generally indicated at 100. The spacer 100 is fabricated in a manner similar to the above-described spacer, shown in FIG. 2, from a suitable rigid material which is water resistant, retaining its structural strength when wet, such as polystyrene foam. The spacer 100 comprises a series of wall portions 102 interconnected by alternating pairs of included angles 104, preferably greater than ninety degrees, forming an elongated member.

When viewed in plan, as in FIG. 5, the spacer 100 resembles a plurality of adjacent W-shaped sections. The wall portions 102 include upper and lower edges, 101 and 103 respectively, which form upper and lower planar support surfaces.

FIG. 7 shows the contemplated use of the spacers 100 wherein a series of the spacers 100 are assembled to form enlarged upper and lower planar surfaces. Each spacer 100 is placed upright on its lower edge 103 and is fastened to adjacent spacers by fasteners 106 which are preferably U-shaped clips, made of plastic or metal. The upper edges 101 of the assembled spacers 100 create a support capable of receiving the bottom of a form for concrete. The vertical voids 108, which result from the assembly of the spacers, occupy a substantial proportion of the total volume occupied by the spacer.

As is apparent, these voids 108 facilitate the permanent deformation of the spacers, to occupy less volume than the non-deformed spacers, when their maximum load bearing capacity is exceeded, in a manner similar to the embodiment of FIGS. 2 through 4.

It is contemplated that the spacers 100 will be sold in convenient lengths, such as eight feet, for assembly as required. As before, the spacers 100 support the lower surface of a form for pouring a concrete foundation member. When expansion of the soil grade occurs after the foundation member has set, the spacers 100 permanently deform to accommodate the reduced spacing between the soil grade and the foundation member.

It will be apparent that by selecting an appropriate material, such as polystyrene foam, and by selecting the span 110, height 120 and wall thickness 130 of the spacers 100, a variety of characteristics can be provided. Table II shows the maximum load for various six inch high spacers and the deformation at which it occurs.

TABLE II

| WALL THICKNESS INCHES | SPAN INCHES | DEFORMATION INCHES | LOAD PSI |
|---|---|---|---|
| 1.00 | 6.00 | 0.32 | 1.9 |
| 1.25 | 6.25 | 0.40 | 2.6 |
| 1.50 | 6.50 | 0.60 | 3.4 |

The embodiment of FIGS. 5 through 7 provide additional advantages in that the spacers are easy to ship to, and assemble at, the construction site as required and they do not require bonding to the form material. They can also be used with any suitable form material such as chipboard, plywood etc. which is available at the construction site.

Figure 9:
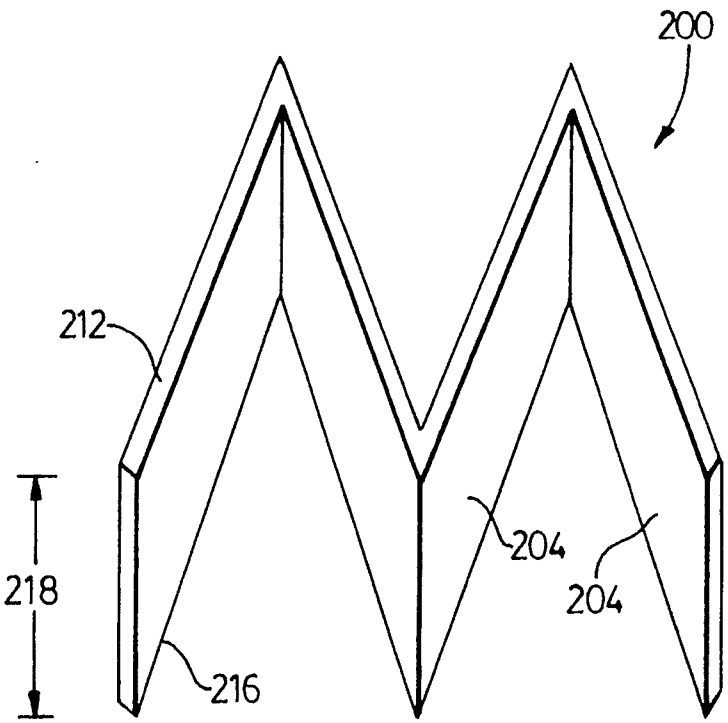
FIG. 9 shows an oblique view of the spacer of FIG. 8.
Figure 8:
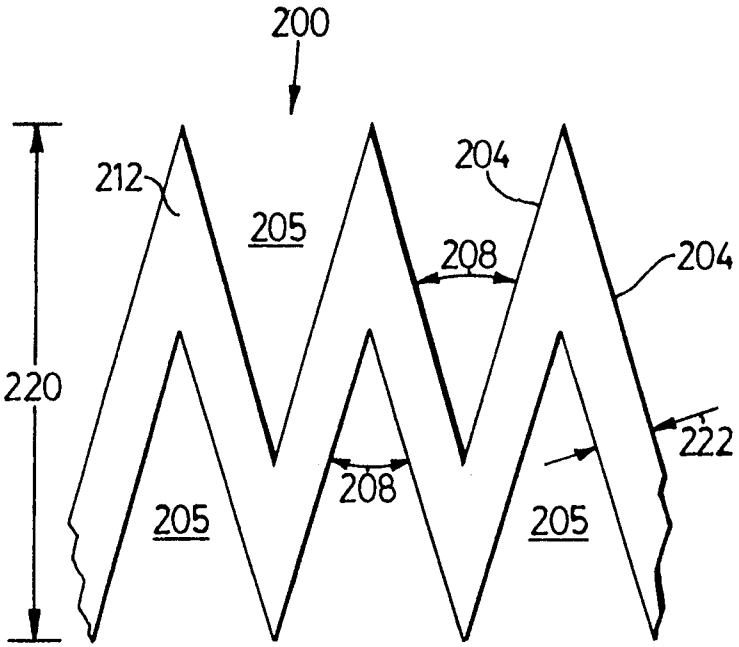
FIG. 8 shows a top view of another spacer.
Figure 10:
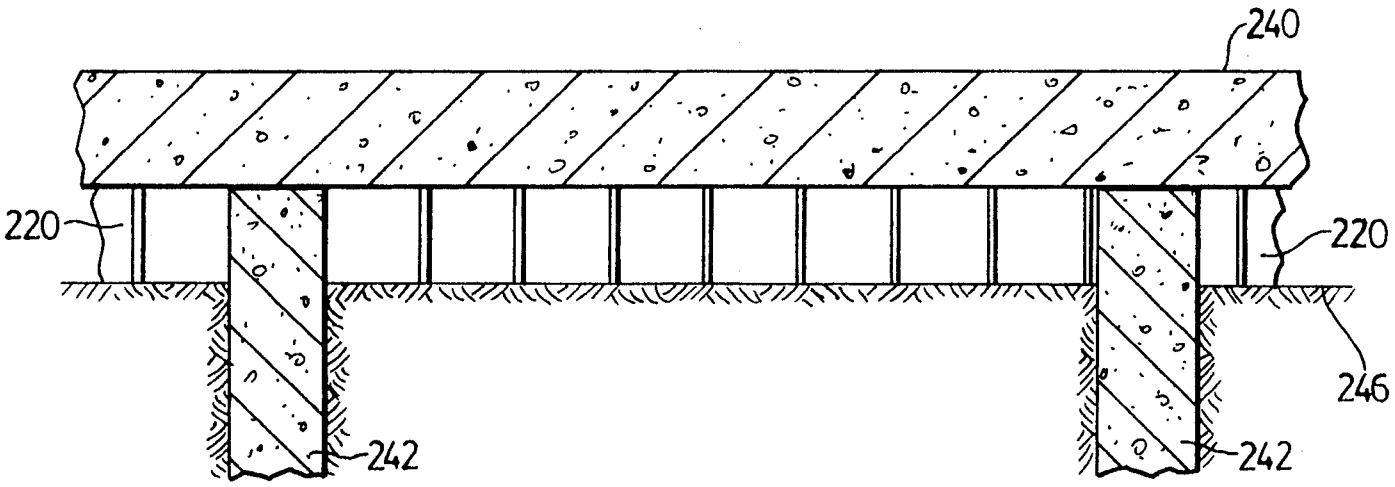
FIG. 10 shows a foundation beam formed with the spacer of FIG. 8.

Another embodiment of the present invention is shown in FIGS. 8 through 10. A spacer 200 is shown which is fabricated from any suitable rigid water resistant material such as polystyrene foam. The spacer includes a series of vertical wall portions 204, which are interconnected at alternating included angles 208 of preferably less than ninety degrees in a generally sawtooth shape, and each wall 204 has upper and lower edges, 212 and 216 respectively. As is apparent, the smaller included angles between these wall portions results in an increase in the load bearing capacity of the spacers.

It will also be apparent that by varying the height 218, span 220 and wall thickness 222, the spacers can be fabricated to provide different load bearing characteristics as required and the vertical voids 205 in the spacer allow the spacer to deform permanently to a shape occupying less volume than the non-deformed spacer.

It is contemplated that spacer 200 is particularly suited for forming grade beams as shown in FIG. 10. A trench in the soil grade has been cut between the pilings 242, previously placed, and a spacer 200 has been laid along the trench. The span of the spacer 200, is substantially the same as the width of the bottom of the beam form. The form for beam 240 has been placed atop the spacer 200 and the concrete has been poured into the form to make the beam. When a subsequent expansion of the soil grade 246 occurs, the spacer member 200 will permanently deform to a reduced volume to accommodate the expansion and prevent heaving or cracking of the beam 240.

It will be apparent to those of skill in the art that other suitable materials such as balsa wood, recycled plastic, etc. may be used to fabricate the spacers provided that the materials have a suitable structural strength and are water resistant, not losing their structural strength when exposed to moisture. It will also be apparent that other shapes can be employed, where desired, without departing from the spirit of the invention, provided that they allow the spacer to permanently deform to a volume which is less than the spacer's non-deformed volume.

We claim:

1. A foundation comprising:

a foundation structure;

a soil grade susceptible to heaving;

a form used to fabricate said foundation structure, the form having an upper surface upon which the foundation structure is disposed; and a spacer of water resistant material to support the dead load of the form and said foundation structure above said soil grade while said foundation structure is being fabricated, the spacer including voids such that, in the event of heaving of said soil grade, said spacer permanently deforms to accommodate the heaved soil thereby inhibiting damage to said foundation structure.

2. A foundation according to claim 1, wherein the spacer includes at least two voids which are elongate and laterally spaced, the longitudinal axis of said voids being substantially horizontal when the spacer is in use.

3. A foundation according to claim 2 wherein the spacer is fixed to a portion of said form.

4. A foundation according to claim 2 wherein said spacer is substantially W-shaped in cross-section.

5. A foundation according to claim 1 wherein the spacer includes at least two voids which are elongate and laterally spaced, the longitudinal axis of said voids being substantially vertical when said spacer is in use.

6. A foundation according to claim 5 wherein said spacer comprises a series of interconnected substantially vertical wall members, said wall members defining said voids therebetween.

7. A foundation according to claim 6 wherein the included angle between said wall members of said spacer is not greater than ninety degrees.

8. A foundation according to claim 1 wherein said material is polystyrene foam.

* * * * *